United States Patent [19]

Narushima et al.

[11] 3,948,836

[45] Apr. 6, 1976

[54] SURFACE TREATMENT COMPOSITION FOR METAL WORKING

[75] Inventors: Uraji Narushima, Yokohama; Kazuhiko Nishimoto, Souka; Shinji Sasakuma, Uji, all of Japan

[73] Assignee: Nippon Paint Co., Ltd., Osaka, Japan

[22] Filed: Apr. 5, 1974

[21] Appl. No.: 458,452

[30] Foreign Application Priority Data

Apr. 5, 1973 Japan ..... 48-39023

[52] U.S. Cl. ..... 260/28.5 A; 260/3.5; 260/23 XA; 260/28.5 D; 260/727; 260/736

[51] Int. Cl.[2] ..... C08L 91/06

[58] Field of Search ..... 260/28.5 A, 28.5 D, 3.5, 260/23 XA, 727, 736

[56] References Cited

UNITED STATES PATENTS 3,819,554 6/1974 Blanchard ..... 260/28.5 D

*Primary Examiner*—Melvyn I. Marquis

*Attorney, Agent, or Firm*—Wenderoth, Lind & Ponack

[57] ABSTRACT

A surface treatment composition for metal working which comprises 20 to 50 parts by weight of a mixture of a chlorine-containing thermoplastic synthetic resin or chlorine-containing rubber having a molecular weight of 8000 to 10000 and a chlorine-containing thermoplastic synthetic resin or chlorine-containing rubber having a molecular weight of 17000 to 19000, 2 to 15 parts by weight of a plasticizer and 2 to 20 parts by weight of a wax having 30 to 80 carbon atoms and melting at 60° to 120°C.

14 Claims, No Drawings

SURFACE TREATMENT COMPOSITION FOR METAL WORKING

The present invention relates to a surface treatment composition for metal working. More particularly, it relates to a lubricating composition for surface treatment for metal working which can be applied on the surface of metals prior to the plastic deformation of them and can facilitate the plastic deformation.

In cold molding of metals such as transformation processing, drawing processing and deep drawing processing, the surface of metals to be processed is usually coated with a treating agent such as lubricating oil, wax, molybdenum or soap prior to the processing. Particularly in case that such processing is difficult, the surface of metals is generally subjected to chemical treatment with a phosphate, an oxalate or the like prior to the above mentioned coating. However, such conventional surface treatment of metals is disadvantageous in various respects: e.g. (1) the strict control of the reaction is necessitated in the chemical treatment; (2) heating is required in the chemical treatment; (3) sludge is formed during the reaction; (4) the treatment of the waste reaction solution makes much troubles; (5) the number of the operation steps is much; (6) such surface treatment is not applicable to a highly advanced processing procedure, for instance, under an increased drawing rate or speed or reduction rate, etc.

There is also known a process of coating with a highly chlorinated higher fatty acid. However, the obtained coating film is not dried nor solidified completely but remains adhesive, so that, in the processing operation, a part of the treating agent hangs down from the metal to make the coating film non uniform and, in extreme cases, renders the operation environment sticky and also handling of the metal very difficult.

The main object of the present invention is to provide a treating agent for surface treatment advantageously utilizable for processing of metals. Another object of this invention is to provide a treating agent for surface treatment which can effectively coat the surface of metals at room temperature without any chemical reaction, which means that there is no necessity for treating the sludge or the waste ordinarily formed during the reaction. A further object of the invention is to provide a treating agent for surface treatment which requires fewer steps of operation and affords a uniform coating film which is sufficiently dried and which exhibits good work-ability and lubricity.

The composition of the treating agent of the invention comprises 20 to 50 parts by weight of a mixture of a thermoplastic synthetic resin containing chlorine or a chlorine-containing rubber, having a molecular weight of 8000 to 10000, and a thermoplastic synthetic resin containing chlorine or a chlorine-containing rubber, having a molecular weight of 17000 to 19000, 2 to 15 parts by weight of a plasticizer and 2 to 20 parts by weight of a wax having 30 to 80 carbon atoms and melting at 60° to 120°C.

The thermoplastic synthetic resin containing chlorine and the chlorine-containing rubber used herein may be conventional ones. Specific examples of them are chlorinated polyethylene, chlorinated polypropylene, polyvinyl chloride, polyvinylidene chloride and chlorinated natural rubber. Among them, the use of the ones having a chlorination rate of 60 % or more is favorable. It is indispensable for the composition of the invention to contain a thermoplastic synthetic resin containing chlorine or the chlorine-containing rubber, having a molecular weight of 8000 to 10000, and a thermoplastic synthetic resin containing chlorine or a chlorine-containing rubber, having a molecular weight of 17000 to 19000, in combination. Particularly by the combined use of the chlorine-containing rubber having a molecular weight of 8000 to 10000 and the chlorine-containing rubber having a molecular weight of 17000 to 19000, there can be expected further improvement in a lubricating property. When the thermoplastic synthetic resins containing chlorine and/or chlorine-containing rubbers, having a molecular weight of 17000 to 19000, are employed solely or in combination, the adhesion of the formed coating film on the surface of the substrate metal becomes inferior. When thermoplastic synthetic resins containing chlorine and/or chlorine-containing rubbers, having a molecular weight of 8000 to 10000, are employed solely or in combination, the adhesion of the formed coating film on the surface of the substrate metal is good, but the lubricity becomes insufficient.

The mixing proportion of the compound having a molecular weight of 17000 to 19000 and the compound having a molecular weight of 8000 to 10000 is desired to be 1 : 1.2 to 1.8 by weight. When the proportions are out of this range, there are caused the above mentioned drawbacks as seen in case of the sole use of the compound having a molecular weight of 17000 to 19000 or the compound having a molecular weight of 8000 to 10000.

As the plasticizer, there may be employed a phthalic acid ester, an adipic acid ester, an alkylphosphoric acid ester, a chlorinated paraffin or the like. The use of chlorinated paraffin, especially having a chlorination rate of 40 to 80 % and a molecular weight of 1000 or more, is preferable.

As the wax, there may be employed animal wax, vegetable wax, petroleum paraffin wax, petrolatum, fine crystalline wax or the like. The use of a wax material having 30 to 80 carbon atoms (preferably 40 to 60 carbon atoms) and a melting point of 60° to 120°C (preferably 70° to 90°C) is favorable. Particularly preferred is a wax containing a side chain and a ring in its molecule and having a fine crystalline structure (i.e. microcrystalline wax). For further improving the lubricating property, the use of microcrystalline wax of plastic type having a melting point of 79° to 80°C is desired. The use of an oil or a fat such as Vaseline, a low molecular weight paraffin or a mineral oil in place of the wax is not favorable, because the formed coating film is very soft and weak and is not able to be sufficiently dried to that its handling becomes difficult. Further, due to its insufficient lubricity, the film is apt to be directly contacted with metal tools at the plastic deformation operation, which results in the formation of die marks on its surface.

In addition to the above mentioned components, the composition of the invention may contain any other conventional additives such as soaps, pigments, dyestuffs, anti-corrosion agents and perfumeries. As the soaps to be incorporated in the composition of the invention, metal salts (e.g. Na, K, Li, Ca, Al, Zn, Pb) of higher fatty acids having 8 to 22 carbon atoms are favorable.

In the composition of the invention, there may be also incorporated one or more kinds of solvents such as alcohols (e.g. ethanol, isopropanol, butanol), esters (e.g. ethyl acetate, butyl acetate, amyl acetate), ethers (e.g. butyl cellosolve, carbitol), ketones (e.g. methyl ethyl ketone, methyl isobutyl ketone), hydrocarbons (e.g. mineral spirit, toluene, xylene, solvent naphtha) and halogenated hydrocarbons (e.g. trichloroethylene, perchloroethylene). The kind of the solvent to be used should be appropriately selected depending on the boiling point, the dissolving ability, the ignition point and the like. The amount of the solvent to be used is usually 1 to 60 % by weight, preferably 10 to 40 % by weight, to the solid content of the composition. When a heavy coating film, e.g. having a weight of 5 g/m$^2$ or more, is desired, it is favorable to use the solvent in such an amount that the solid content of the composition becomes 10 % by weight or more.

The composition of the invention can be applied on the surface of a metal substrate by a conventional procedure such as immersion, flow coating, spraying or roll coating.

The coating film prepared from the composition of the invention is completely dried and not sticky at all so that the coated metal can be handled with ease without sticking. Further, the coating film of the invention has a uniform thickness and a flat and smooth surface and shows good processability with lubricity. In addition, by the use of the composition of the invention, highly advanced drawing processing of stainless steel tubes can be effected with shortened operation steps and repetition of the treatment for the processing at every drawing operation is not required thereby, as shown in the hereinafter mentioned Example 5, unlike conventional procedures.

Thus, the composition of the invention can be advantageously employed in transformation processing, especially in drawing processing.

The practical and presently preferred embodiments of the invention are illustratively shown in the following Examples wherein parts and % are by weight.

EXAMPLE 1

Composition 1

| | |
|---|---|
| Chlorinated polypropylene (molecular weight, about 9000) | 1.25 parts |
| Chlorinated rubber (molecular weight, about 18000) | 0.83 part |
| Chlorinated paraffin (chlorination rate, 70 %) | 0.83 part |
| Microcrystalline wax (before purification) | 5.00 parts |
| Calcium stearate | 10.00 parts |
| Bentonite | 0.09 part |
| 3,4-Epoxycyclohexylmethyl-3,4-epoxycycolhexanecarboxylate | 0.04 part |
| Toluene | 3.72 parts |
| Perchloroethylene | 78.24 parts |
| | 100.00 parts |

Composition 2

| | |
|---|---|
| Chlorinated polypropylene (molecular weight, about 9000) | 1.25 parts |
| Chlorinated polypropylene (molecular weight, about 18000) | 0.83 part |
| Chlorinated paraffin (chlorination rate, 70 %) | 0.83 part |
| Microcrystalline wax (before purification) | 5.00 parts |
| Calcium stearate | 10.00 parts |
| Bentonite | 0.09 part |
| 3,4-Epoxycyclohexylmethyl-3,4-epoxycyclohexanecarboxylate | 0.04 part |
| Toluene | 3.72 parts |
| Perchloroethylene | 78.24 parts |
| | 100.00 parts |

Composition 3

| | |
|---|---|
| Chlorinated rubber (molecular weight, about 9000) | 1.25 parts |
| Chlorinated polypropylene (molecular weight, about 18000) | 0.83 parts |
| Chlorinated paraffin (chlorination rate, 70 %) | 0.83 part |
| Microcrystalline wax (before purification) | 5.00 parts |
| Calcium stearate | 10.00 parts |
| Bentonite | 0.09 part |
| 3,4-Epoxycyclohexylmethyl-3,4-epoxycyclohexanecarboxylate | 0.04 part |
| Toluene | 3.72 parts |
| Perchloroethylene | 78.24 parts |
| | 100.00 parts |

-continued

Composition 4

| | |
|---|---|
| Chlorinated rubber (molecular weight, about 9000) | 1.25 parts |
| Chlorinated rubber (molecular weight, about 18000) | 0.83 part |
| Chlorinated paraffin (chlorination rate, 70 %) | 0.83 part |
| Microcrystalline wax (before purification) | 5.00 parts |
| Calcium stearate | 10.00 parts |
| Bentonite | 0.09 part |
| 3,4-Epoxycyclohexylmethyl-3,4-epoxycyclohexanecarboxylate | 0.04 part |
| Toluene | 3.72 parts |
| Perchloroethylene | 78.24 parts |
| | 100.00 parts |

Composition 5

| | |
|---|---|
| Chlorinated polypropylene (molecular weight, about 9000) | 1.25 parts |
| Chlorinated rubber (molecular weight, about 18000) | 0.83 part |
| Chlorinated paraffin (chlorination rate, 70 %) | 0.83 part |
| Microcrystalline wax (plastic type) | 5.00 parts |
| Calcium stearate | 10.00 parts |
| Bentonite | 0.09 part |
| 3,4-Epoxycyclohexylmethyl-3,4-epoxycyclohexanecarboxylate | 0.04 part |
| Toluene | 3.72 parts |
| Perchloroethylene | 78.24 parts |
| | 100.00 parts |

Composition 6

| | |
|---|---|
| Chlorinated polypropylene (molecular weight, about 9000) | 1.25 parts |
| Chlorinated polypropylene (molecular weight, about 18000) | 0.83 part |
| Chlorinated paraffin (chlorination rate, 70 %) | 0.83 part |
| Microcrystalline wax (plastic type) | 5.00 parts |
| Calcium stearate | 10.00 parts |
| Bentonite | 0.09 part |
| 3,4-Epoxycyclohexylmethyl-3,4-epoxycyclohexanecarboxylate | 0.04 part |
| Toluene | 3.72 parts |
| Perchloroethylene | 78.24 parts |
| | 100.00 parts |

Composition 7

| | |
|---|---|
| Chlorinated rubber (molecular weight, about 9000) | 1.25 parts |
| Chlorinated polypropylene (molecular weight, about 18000) | 0.83 parts |
| Chlorinated paraffin (chlorination rate, 70 %) | 0.83 parts |
| Microcrystalline wax (plastic type) | 5.00 parts |
| Calcium stearate | 10.00 parts |
| Bentonite | 0.09 part |
| 3,4-Epoxycyclohexylmethyl-3,4-epoxycyclohexanecarboxylate | 0.04 part |
| Toluene | 3.72 parts |
| Perchloroethylene | 78.24 parts |
| | 100.00 parts |

Composition 8

| | |
|---|---|
| Chlorinated rubber (molecular weight, about 9000) | 1.25 parts |
| Chlorinated rubber (molecular weight, about 18000) | 0.83 parts |
| Chlorinated paraffin (chlorination rate, 70 %) | 0.83 part |
| Microcrystalline wax (plastic type) | 5.00 parts |
| Calcium stearate | 10.00 parts |

-continued

| | |
|---|---|
| Bentonite | 0.09 part |
| 3,4-Epoxycyclohexylmethyl-3,4-epoxycyclohexanecarboxylate | 0.04 part |
| Toluene | 3.72 parts |
| Perchloroethylene | 78.24 parts |
| | 100.00 parts |

Each of the above compositions 1 to 8 (100 parts) is admixed with perchloroethylene (70 parts). In the obtained mixture, a steel panel (7 cm × 15 cm) previously degreased with a weakly alkaline degreasing agent and washed is immersed at room temperature (about 20°C). After about 10 seconds, the panel is taken out and dried at room temperature. In all cases, the coating film formed on the panel has a substantially even thickness and is completely dried, not sticky, and flat and smooth, and any wave-like marks are not observed thereupon.

EXAMPLE 2

Composition 9

| | |
|---|---|
| Chlorinated polypropylene (molecular weight, about 9000) | 8.05 parts |
| Chlorinated rubber (molecular weight, about 18000) | 5.37 parts |
| Chlorinated paraffin (chlorination rate, 70 %) | 5.37 parts |
| Microcrystalline wax (before purification) | 3.60 parts |
| 3,4-Epoxycyclohexylmethyl-3,4-epoxycyclohexanecarboxylate | 0.22 part |
| Toluene | 23.89 parts |
| Perchloroethylene | 48.50 parts |
| | 100.00 parts |

Composition 10

| | |
|---|---|
| Chlorinated polypropylene (molecular weight, about 9000) | 8.05 parts |
| Chlorinated polypropylene (molecular weight, about 18000) | 5.37 parts |
| Chlorinated paraffin (chlorination rate, 70 %) | 5.37 parts |
| Microcrystalline wax (before purification) | 3.60 parts |
| 3,4-Epoxycyclohexylmethyl-3,4-epoxycyclohexanecarboxylate | 0.22 part |
| Toluene | 23.89 parts |
| Perchloroethylene | 48.50 parts |
| | 100.00 parts |

Composition 11

| | |
|---|---|
| Chlorinated rubber (molecular weight, about 9000) | 8.05 parts |
| Chlorinated polypropylene (molecular weight, about 18000) | 5.37 parts |
| Chlorinated paraffin (chlorination rate, 70 %) | 5.37 parts |
| Microcrystalline wax (before purification) | 3.60 parts |
| 3,4-Epoxycyclohexylmethyl-3,4-epoxycyclohexanecarboxylate | 0.22 part |
| Toluene | 23.89 part |
| Perchloroethylene | 48.50 parts |
| | 100.00 parts |

Composition 12

| | |
|---|---|
| Chlorinated rubber (molecular weight, about 9000) | 8.05 parts |
| Chlorinated rubber (molecular weight, about 18000) | 5.37 parts |
| Chlorinated paraffin (chlorination rate, 70 %) | 5.37 parts |
| Microcrystalline wax (before purification) | 3.60 parts |
| 3,4-Epoxycyclohexylmethyl-3,4-epoxycyclohexanecarboxylate | 0.22 part |
| Toluene | 23.89 parts |
| Perchloroethylene | 48.50 parts |
| | 100.00 parts |

Composition 13

| | |
|---|---|
| Chlorinated polypropylene (molecular weight, about 9000) | 8.05 parts |

-continued

| | |
|---|---|
| Chlorinated rubber (molecular weight, about 18000) | 5.37 parts |
| Chlorinated paraffin (chlorination rate, 70 %) | 5.37 parts |
| Microcrystalline wax (plastic type) | 8.60 parts |
| 3,4-Epoxycyclohexylmethyl-3,4-epoxycyclohexanecarboxylate | 0.22 part |
| Toluene | 23.89 parts |
| Perchloroethylene | 48.50 parts |
| | 100.00 parts |

Composition 14

| | |
|---|---|
| Chlorinated polypropylene (molecular weight, 9000) | 8.05 parts |
| Chlorinated polypropylene (molecular weight, about 18000) | 5.37 parts |
| Chlorinated paraffin (chlorination rate, 70 %) | 5.37 parts |
| Microcrystalline wax (plastic type) | 8.60 parts |
| 3,4-Epoxycyclohexylmethyl-3,4-epoxycyclohexanecarboxylate | 0.22 part |
| Toluene | 23.89 parts |
| Perchloroethylene | 48.50 parts |
| | 100.00 parts |

Composition 15

| | |
|---|---|
| Chlorinated rubber (molecular weight, about 9000) | 8.05 parts |
| Chlorinated polypropylene (molecular weight, about 18000) | 5.37 parts |
| Chlorinated paraffin (chlorination rate, 70 %) | 5.37 parts |
| Microcrystalline wax (plastic type) | 8.60 parts |
| 3,4-Epoxycyclohexylmethyl-3,4-epoxycyclohexanecarboxylate | 0.22 part |
| Toluene | 23.89 parts |
| Perchloroethylene | 48.50 parts |
| | 100.00 parts |

Composition 16

| | |
|---|---|
| Chlorinated rubber (molecular weight, about 9000) | 8.05 parts |
| Chlorinated rubber (molecular weight, about 18000) | 5.37 parts |
| Chlorinated paraffin (chlorination rate, 70 %) | 5.37 parts |
| Microcrystalline wax (plastic type) | 8.60 parts |
| 3,4-Epoxycyclohexylmethyl-3,4-epoxycyclohexanecarboxylate | 0.22 part |
| Toluene | 23.89 parts |
| Perchloroethylene | 48.50 parts |
| | 100.00 parts |

Each of the above compositions 9 to 16 (100 parts) is admixed with perchloroethylene (100 parts). Using the obtained mixture, the formation of a coating film on a steel panel is carried out as in Example 1. In all cases, the formed coating film has a substantially even thickness and is completely dried, not sticky, and flat and smooth, and any wave-like marks are not observed thereupon.

EXAMPLE 3

Composition 17

| | |
|---|---|
| Chlorinated polypropylene (molecular weight, about 9000) | 31.25 parts |
| Chlorinated paraffin (chlorination rate, 70 %) | 31.25 parts |
| "Chissonox" (stabilizer for resins) | 1.25 parts |
| Toluene | 13.59 parts |
| Perchloroethylene | 22.66 parts |
| | 100.00 parts |

Composition 18

| | |
|---|---|
| Chlorinated rubber (molecular weight, about 18000) | 15.20 parts |
| Chlorinated paraffin (chlorination rate, 70 %) | 15.20 parts |
| "Chissonox" | 0.61 part |

-continued

| | |
|---|---|
| Toluene | 25.87 parts |
| Perchloroethylene | 43.12 parts |
| | 100.00 parts |

Composition 19

| | |
|---|---|
| Chlorinated polypropylene (molecular weight, about 9000) | 18.75 parts |
| Chlorinated rubber (molecular weight, about 18000) | 12.50 parts |
| Chlorinated paraffin (chlorination rate, 70 %) | 12.50 parts |
| "Chissonox" | 0.50 part |
| Toluene | 20.91 parts |
| Perchloroethylene | 34.84 parts |
| | 100.00 parts |

Composition 20

| | |
|---|---|
| Chlorinated rubber (molecular weight, about 18000) | 12.50 parts |
| Chlorinated rubber (molecular weight, about 9000) | 18.75 parts |
| Chlorinated paraffin (chlorination rate, 70 %) | 12.50 parts |
| "Chissonox" | 0.50 parts |
| Toluene | 20.91 parts |
| Perchloroethylene | 34.84 parts |
| | 100.00 parts |

Each of the above compositions 17 to 20 (100 parts) is admixed with perchloroethylene (100 parts). Using the obtained mixture, the formation of a coating film on a stainless steel tube is carried out as in Example 1. The formed coating film is subjected to processing under the following conditions:

Material: stainless steel tube (SUS-27) (outer diameter, 35.0 mm; thickness, 3.0 mm)

Drawing speed: 20 m/min

Processing method: so

1. Floating plug method
2. Bar drawing method

In case of the floating plug method, the procedure is repeated twice continuously, and in case of the bar drawing method, the procedure is repeated three times continuously. Recoating and annealing at every processing operation are not executed.

The results are shown in Table 1 in which the symbols have the following meanings, respectively:

○ : The drawing processing is normally effected.

Δ : A small amount of wave-like dies marks are observed on the surface of the steel tube.

x : The lubricity is insufficient, and a large amount of wave-like dies marks are observed on the surface of the steel tube, or the tube is broken.

— : The drawing cannot be executed.

The stabilizer for resins "Chissonox" as used in Example 3 is 3,4-epoxycyclohexylmethyl-3,4-epoxycyclohexanecarboxylate.

Table 1

| Procedure | Results Floating plug method | | Bar drawing method | | |
|---|---|---|---|---|---|
| Number of times of drawing | 1 | 2 | 1 | 2 | 3 |
| Size (mm) | 35.0 × 3.00 ↓ 29.0 × 2.25 | 29.0 × 2.25 ↓ 24.0 × 1.75 | 35.0 × 3.0 ↓ 33.0 × 2.5 | 33.0 × 2.5 ↓ 31.0 × 2.0 | 31.0 × 2.0 ↓ 29.0 × 1.5 |
| Reduction rate (%) | 37.3 | 22.1 | 20.6 | 19.0 | 17.4 |
| Composition No. 17 | x | — | x | — | — |
| Composition No. 18 | x | — | x | — | — |
| Composition No. 19 | x | — | Δ | x | — |
| Composition No. 20 | Δ | x | ○ | x | — |

From Table 1, it is apparent that the composition not containing the wax of the invention affords a coating film being inferior in processability.

EXAMPLE 4

Composition 21

| | |
|---|---|
| Chlorinated polypropylenes (molecular weight, about 9000) | 16.45 parts |
| Microcrystalline wax (plastic type) | 10.53 parts |
| "Chissonox" | 0.66 part |
| Toluene | 27.14 parts |
| Perchloroethylene | 45.22 parts |
| | 100.00 parts |

Composition 22

| | |
|---|---|
| Chlorinated rubber (molecular weight, about 18000) | 16.45 parts |
| Microcrystalline wax (plastic type) | 10.53 parts |
| "Chissonox" | 0.66 part |
| Toluene | 27.14 parts |
| Perchloroethylene | 45.22 parts |
| | 100.00 parts |

Composition 23

| | |
|---|---|
| Chlorinated polypropylene (molecular weight, about 9000) | 9.87 parts |
| Chlorinated rubber (molecular weight, about 18000) | 6.58 parts |
| Microcrystalline wax (plastic type) | 10.53 parts |
| "Chissonox" | 0.26 part |
| Toluene | 27.29 parts |
| Perchloroethylene | 45.47 parts |
| | 100.00 parts |

Composition 24

| | |
|---|---|
| Chlorinated rubber (molecular weight, about 9000) | 9.87 parts |
| Chlorinated rubber (molecular weight, about 18000) | 6.58 parts |
| Microcrystalline wax (plastic type) | 10.53 parts |
| "Chissonox" | 0.26 parts |
| Perchloroethylene | 45.47 parts |
| | 100.00 parts |

Composition 25

| | |
|---|---|
| Chlorinated polypropylene (molecular weight, about 9000) | 13.42 parts |
| Chlorinated paraffin (chlorination rate, 70 %) | 13.42 parts |
| Microcrystalline wax (plastic type) | 8.60 parts |
| "Chissonox" | 0.54 part |
| Toluene | 24.01 parts |
| Perchloroethylene | 40.01 parts |
| | 100.00 parts |

Composition 26

| | |
|---|---|
| Chlorinated rubber (molecular weight, about 18000) | 13.42 parts |
| Chlorinated paraffin (chlorination rate, 70 %) | 13.42 parts |
| Microcrystalline wax (plastic type) | 8.60 parts |
| "Chissonox" | 0.54 parts |
| Toluene | 24.01 parts |
| Perchloroethylene | 40.01 parts |
| | 100.00 parts |

Each of the above compositions 21 to 26 (100 parts) is admixed with perchloroethylene (100 parts). Using the obtained mixture, the formation of a coating film on a stainless steel tube is carried out as in Example 1.

The formed coating film is subjected to processing as in Example 3.

The results are shown in Table 2.

Table 2

| Procedure | | Results Floating plug method | | Bar drawing method | | |
|---|---|---|---|---|---|---|
| Number of times of drawing | | 1 | 2 | 1 | 2 | 3 |
| Size (mm) | | 35.0 × 3.00 ↓ 29.0 × 2.25 | 29.0 × 2.25 ↓ 24.0 × 1.75 | 35.0 × 3.0 ↓ 33.0 × 2.5 | 33.0 × 2.5 ↓ 31.0 × 2.0 | 31.0 × 2.0 ↓ 29.0 × 1.5 |
| Reduction rate (%) | | 37.3 | 22.1 | 20.6 | 19.0 | 17.4 |
| Composition No. | 21 | x | x | ○ | x | — |
| | 22 | x | x | ○ | x | — |
| | 23 | ○ | x | ○ | ○ | Δ |
| | 24 | ○ | ○ | ○ | ○ | x |
| | 25 | ○ | x | ○ | ○ | x |
| | 26 | ○ | x | ○ | ○ | x |

It is apparent from Table 2 that when the plasticizer of the invention is not used or the compound having a molecular weight of 8000 to 10000 or the compound having a molecular weight of 17000 to 19000 is employed solely, the obtained coating film becomes inferior in processibility.

EXAMPLE 5

Composition 27

| | |
|---|---|
| Chlorinated polypropylene (molecular weight, about 9000) | 8.05 parts |
| Chlorinated rubber (molecular weight, about 18000) | 5.37 parts |
| Microcrystalline wax (plastic type) | 3.80 parts |
| "Chissonox" | 0.22 part |
| Toluene | 28.95 parts |
| Perchloroethylene | 48.24 parts |
| | 100.00 parts |

Composition 28

| | |
|---|---|
| Chlorinated polypropylene (molecular weight, about 9000) | 8.05 parts |
| Chlorinated rubber (molecular weight, about 18000) | 5.37 parts |
| Chlorinated paraffin (chlorination rate, 70 %) | 5.37 parts |
| Microcrystalline wax (plastic type) | 8.60 parts |
| "Chissonox" | 0.22 part |
| Toluene | 27.15 parts |
| Perchloroethylene | 45.24 parts |
| | 100.00 parts |

Composition 29

| | |
|---|---|
| Chlorinated polypropylene (molecular weight, about 18000) | 8.60 parts |
| Chlorinated rubber (molecular weight, about 18000) | 5.37 parts |
| Chlorinated paraffin (chlorination rate, 70 %) | 5.37 parts |
| Microcrystalline wax (plastic type) | 8.60 parts |
| "Chissonox" | 0.22 part |
| Toluene | 27.15 parts |
| Perchloroethylene | 45.24 parts |
| | 100.00 parts |

Composition 30

| | |
|---|---|
| Chlorinated rubber (molecular weight, about 9000) | 8.05 parts |
| Chlorinated rubber (molecular weight, about 18000) | 5.37 parts |
| Chlorinated paraffin (chlorination rate, 70 %) | 5.37 parts |
| Microcrystalline wax (plastic type) | 8.60 parts |
| "Chissonox" | 0.22 part |
| Toluene | 27.15 parts |
| Perchloroethylene | 45.24 parts |
| | 100.00 parts |

-continued

Composition 31

| | |
|---|---|
| Chlorinated polypropylene (molecular weight, about 9000) | 8.05 parts |
| Chlorinated rubber (molecular weight, about 18000) | 5.37 parts |
| Chlorinated paraffin (chlorination rate, 70 %) | 5.37 parts |
| Microcrystalline wax (before purification) | 8.60 parts |
| "Chissonox" | 0.22 part |
| Toluene | 27.15 parts |
| Perchloroethylene | 45.24 parts |
| | 100.00 parts |

Composition 32

| | |
|---|---|
| Chlorinated polypropylene (molecular weight, about 9000) | 8.05 parts |
| Chlorinated rubber (molecular weight, about 18000) | 5.37 parts |
| Chlorinated paraffin (chlorination rate, 70 %) | 5.37 parts |
| Microcrystalline wax (hard type) | 8.60 parts |
| "Chissonox" | 0.22 part |
| Toluene | 27.15 parts |
| Perchloroethylene | 45.24 parts |
| | 100.00 parts |

Composition 33

| | |
|---|---|
| Chlorinated polypropylene (molecular weight, about 9000) | 8.05 parts |
| Chlorinated rubber (molecular weight, about 18000) | 5.37 parts |
| Chlorinated paraffin (chlorination rate, 70 %) | 5.37 parts |
| Microcrystalline wax (plastic type) | 11.41 parts |
| "Chissonox" | 0.22 parts |
| Toluene | 26.09 parts |
| Perchloroethylene | 43.49 parts |
| | 100.00 parts |

Composition 34

| | |
|---|---|
| Chlorinated polypropylene (molecular weight, about 9000) | 3.60 parts |
| Chlorinated rubber (molecular weight, about 18000) | 2.40 parts |
| Chlorinated paraffin (chlorination rate, 70 %) | 2.40 parts |
| Microcrystalline wax (plastic type) | 25.00 parts |
| "Chissonox" | 0.10 part |
| Toluene | 24.94 parts |
| Perchloroethylene | 41.56 parts |
| | 100.00 parts |

Composition 35

| | |
|---|---|
| Chlorinated polypropylene (molecular weight, about 9000) | 12.00 parts |
| Chlorinated rubber (molecular weight, about 18000) | 8.00 parts |
| Chlorinated paraffin (chlorination rate, 70 %) | 8.00 parts |
| Microcrystalline wax (plastic type) | 1.00 part |
| "Chissonox" | 0.32 part |
| Toluene | 26.51 parts |
| Perchloroethylene | 44.17 parts |
| | 100.00 parts |

Each of the above compositions 27 to 35 (100 parts) is admixed with perchloroethylene (100 parts). Using the obtained mixture, the formation of a coating film on a stainless steel tube is carried out as in Example 1. The formed coating film is subjected to processing as in Example 3.

CONTROL EXAMPLE

The formation of a coating film on a stainless steel tube is carried out by a conventional procedure comprising the oxalate treatment and the soap treatment.

The formed coating film is subjected to processing as in Example 3.

The results are shown in Table 3.

Table 3

| Procedure | | Results Floating plug method | | Bar drawing method | | |
|---|---|---|---|---|---|---|
| Number of times of drawing | | 1 | 2 | 1 | 2 | 3 |
| Size (mm) | | 35.0 × 3.00 ↓ 29.0 × 2.25 | 29.0 × 2.25 ↓ 24.0 × 1.75 | 35.0 × 3.0 ↓ 33.0 × 2.5 | 33.0 × 2.5 ↓ 31.0 × 2.0 | 31.0 × 2.0 ↓ 29.0 × 1.5 |
| Reduction rate (%) | | 37.3 | 22.1 | 20.6 | 19.0 | 17.4 |
| Composition No. | 27 | ○ | ○ | ○ | ○ | ○ |
| | 28 | ○ | ○ | ○ | ○ | ○ |
| | 29 | ○ | ○ | ○ | ○ | ○ |
| | 30 | ○ | ○ | ○ | ○ | ○ |
| | 31 | ○ | Δ | ○ | ○ | ○ |
| | 32 | ○ | Δ | ○ | ○ | ○ |
| | 33 | ○ | ○ | ○ | ○ | ○ |
| | 34 | ○ | x | ○ | ○ | x |
| | 35 | ○ | x | ○ | ○ | x |
| Control Example | | ○ | x | ○ | x | — |

As apparent from Table 3, the film prepared from the composition of the invention (not including the compositions 34 and 35 in which the amount of the microcrystalline wax is out of the range of the invention) shows an excellent processability, compared with the film obtained by the conventional procedure comprising the oxalate treatment and the soap treatment, and can be continuously subjected to the drawing processing without being recoated at every processing. The compositions 27, 28, 29, 30 and 33 can afford good results in high reduction rate. Among them, the composition 30 comprising the chlorine-containing rubber having a molecular weight of about 9000 and the chlorine-containing rubber having a molecular weight of about 18000 is particularly superior to the rests in smooth drawing state and in beautiful appearance of the drawn tube. It is confirmed from the results obtained in the cases of the compositions 31 and 32 that the processability is varied depending on the melting point of the wax (microcrystalline wax before purified, 77°C; microcrystalline wax of hard type, 83° to 90°C; microcrystalline wax of plastic type, 79° to 82°C).

The lubricating effect of the composition of the invention is much elevated by the incorporation of carbon fluoride therein usually in an amount of about 1 to 20 parts to 54 to 165 parts of the composition. In the case wherein the amount is less than the lower limit, a satisfactory effect cannot be obtained. In the case of the amount being more than the upper limit, the adhesion to the surface of the metal substrate becomes inferior and the multi-step processing is made difficult. The following example illustrates the effect of carbon fluoride:

EXAMPLE 6

| Composition 36 | |
|---|---|
| Chlorinated polypropylene (molecular weight, about 9000) | 8.05 parts |
| Chlorinated rubber (molecular weight, about 18000) | 5.37 parts |
| Chlorinated paraffin (chlorination rate, 70 %) | 5.37 parts |
| Microcrystalline wax (plastic type) | 8.60 parts |
| Carbon fluoride | 5.00 parts |

-continued

| | |
|---|---|
| "Chissonox" | 0.22 part |
| Toluene | 27.15 parts |
| Perchloroethylene | 40.24 parts |
| | 100.00 parts |

The above composition 36 (100 parts) is admixed with perchloroethylene (100 parts). Using the obtained mixture, the formation of a coating film on a stainless steel tube is carried out as in Example 1. The formed coating film is subjected to processing as in Example 3

The results are shown in Table 4.

Table 4

| Procedure | Results Floating plug method | | Bar drawing method | | |
|---|---|---|---|---|---|
| Number of times of drawing | 1 | 2 | 1 | 2 | 3 |
| Size (mm) | 35.0 × 3.00 ↓ 29.0 × 2.25 | 29.0 × 2.25 ↓ 24.0 × 1.75 | 35.0 × 3.0 ↓ 33.0 × 2.5 | 33.0 × 2.5 ↓ 31.0 × 2.0 | 31.0 × 2.0 ↓ 29.0 × 1.5 |
| Reduction rate (%) | 37.3 | 22.1 | 20.6 | 19.0 | 17.4 |
| Composition No. 36 | ○ | ○ | ○ | ○ | ○ |

What is claimed is:

1. A surface treatment composition for metal working which comprises 20 to 50 parts by weight of (A) a mixture of (A-1) a chlorine-containing thermoplastic synthetic resin or chlorine-containing rubber having a molecular weight of 8000 to 10,000, which resin and rubber materials are selected from the group consisting of chlorinated polyethylene, chlorinated polypropylene, polyvinyl chloride, polyvinylidene chloride and chlorinated natural rubber and (A-2) a chlorine-containing thermoplastic synthetic resin or chlorine-containing rubber having a molecular weight of 17,000 to 19,000, which resin or rubber materials are selected from the group consisting of chlorinated polyethylene, chlorinated polypropylene, polyvinyl chloride, polyvinylidene chloride and chlorinated natural rubber, wherein the ratio of the component (A-1) to the component (A-2) is about 1.2 : 1 to 1.8 : 1 by weight, 2 to 15 parts by weight of (B) a plasticizer selected from the group consisting of phthalates, adipates, alkylphosphates and chlorinated paraffins and 2 to 20 parts by weight of (C) a wax having 30 to 80 carbon atoms and melting at 60 to 120°C, said wax being selected from the group consisting of animal wax, vegetable wax, petroleum paraffin wax, petrolatum and microcrystalline wax.

2. The composition according to claim 1, which further comprises carbon fluoride.

3. The composition according to claim 1, wherein the component (A-1) is a chlorine-containing rubber and the component (A-2) is a chlorine-containing rubber.

4. The composition according to claim 1, wherein the component (A-1) or the component (A-2) is the one having a chlorination rate of not less than about 60 %.

5. The composition according to claim 1, wherein the component (B) is a chlorinated paraffin having a chlorination rate of about 40 to 80 % and a molecular weight of not less than 1000.

6. The composition according to claim 1, wherein the component (C) is the one having 30 to 80 carbon atoms and a melting point of 60° to 120°C.

7. The composition according to claim 6, wherein the component (C) is a crude type microcrystalline wax.

8. The composition according to claim 6, wherein the component (C) is a hard type microcrystalline wax.

9. The composition according to claim 6, wherein the component (C) is the one having 40 to 60 carbon atoms and a melting point of 70° to 90°C.

10. The composition according to claim 9, wherein the component (C) is a plastic type microcrystalline wax.

11. The composition according to claim 1, which further comprises a solvent.

12. The composition according to claim 11, wherein the solvent is a member selected from the group consisting of alcohols, esters, ethers, ketones, hydrocarbons and halogenated hydrocarbons.

13. The composition according to claim 11, wherein the solvent is employed in an amount that the solid content in the composition is made 1 to 60 % by weight.

14. The composition according to claim 13, wherein the solid content is made 10 to 40 % by weight.

* * * * *